US011066235B2

(12) United States Patent
Hildebrand et al.

(10) Patent No.: US 11,066,235 B2
(45) Date of Patent: Jul. 20, 2021

(54) GARBAGE CAN RISER SYSTEM

(71) Applicants: Troy Hildebrand, Licking, MO (US); Carol Hildebrand, Licking, MO (US)

(72) Inventors: Troy Hildebrand, Licking, MO (US); Carol Hildebrand, Licking, MO (US)

( * ) Notice: Subject to any disclaimer, the term of this patent is extended or adjusted under 35 U.S.C. 154(b) by 134 days.

(21) Appl. No.: 16/453,333

(22) Filed: Jun. 26, 2019

(65) Prior Publication Data

US 2020/0407158 A1 Dec. 31, 2020

(51) Int. Cl.

| | |
|---|---|
| ***B65F 1/14*** | (2006.01) |
| ***B65F 1/16*** | (2006.01) |
| *B65D 21/08* | (2006.01) |
| *B65F 1/06* | (2006.01) |

(52) U.S. Cl.

CPC ..... *B65F 1/14* (2013.01); *B65F 1/1607* (2013.01); *B65D 21/083* (2013.01); *B65F 1/06* (2013.01)

(58) Field of Classification Search

CPC .. B65F 1/14; B65F 1/1607; B65F 1/16; B65F 1/06; B65D 21/083; B65D 21/08; B65D 21/086; B65D 43/16

USPC ..... 220/8, 694, 700, 701, 729, 908.3, 908.1, 220/908, 495.06, 825, 810

See application file for complete search history.

(56) References Cited

U.S. PATENT DOCUMENTS

| | | | | |
|---|---|---|---|---|
| 816,989 | A * | 4/1906 | Moler et al. | B65F 1/06 220/495.1 |
| 1,161,089 | A * | 11/1915 | Waldo, Jr. | B65F 1/1607 220/315 |
| 2,873,052 | A * | 2/1959 | Atherton | B65D 25/48 222/570 |
| 3,127,052 | A * | 3/1964 | Mayers | B65F 1/06 220/495.11 |
| 3,184,100 | A * | 5/1965 | Thomas | B65F 1/10 220/495.08 |
| 3,964,630 | A * | 6/1976 | Getz | B65F 1/06 220/4.01 |
| 4,444,355 | A * | 4/1984 | Cary | B65D 5/68 220/495.11 |
| 6,206,231 | B1 * | 3/2001 | Laughton | B65F 1/1607 220/825 |
| 6,234,339 | B1 | 5/2001 | Thomas | |
| 6,250,492 | B1 * | 6/2001 | Verbeek | B65F 1/06 220/495.08 |
| 6,364,147 | B1 | 4/2002 | Meinzinger | |
| 7,077,283 | B2 | 7/2006 | Yang | |
| 7,922,023 | B2 * | 4/2011 | Dommerholt | B65F 1/10 220/262 |
| 8,087,532 | B2 | 1/2012 | Brown | |
| 9,051,093 | B2 | 6/2015 | Yang | |
| 9,790,025 | B2 | 10/2017 | Yang | |

* cited by examiner

*Primary Examiner* — Robert J Hicks

(57) ABSTRACT

A garbage can riser system for facilitating a flip lid on a garbage can to be opened when the garbage can is full includes a garbage can that has a top end. A riser is provided and the riser is positionable on the top end of the garbage can for increasing a functional height of the garbage can. A flip lid is positionable on the riser such that the flip lid is spaced above garbage contained in the garbage can. In this way the entire volume of the garbage can be filled with garbage without having the flip lid contacting the garbage when the flip lid is opened.

5 Claims, 5 Drawing Sheets

GARBAGE CAN RISER SYSTEM

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to riser devices and more particularly pertains to a new riser device for facilitating a flip lid on a garbage can to be opened when the garbage can is full.

BRIEF SUMMARY OF THE INVENTION

An embodiment of the disclosure meets the needs presented above by generally comprising a garbage can that has a top end. A riser is provided and the riser is positionable on the top end of the garbage can for increasing a functional height of the garbage can. A flip lid is positionable on the riser such that the flip lid is spaced above garbage contained in the garbage can. In this way the entire volume of the garbage can be filled with garbage without having the flip lid contacting the garbage when the flip lid is opened.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
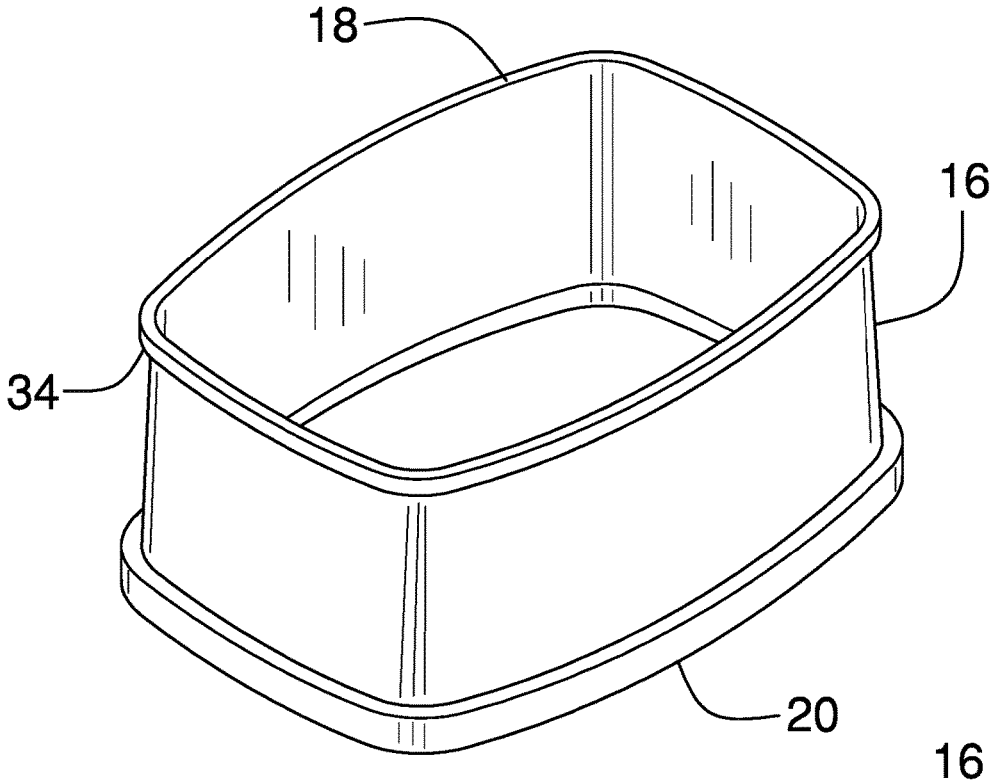
FIG. 1 is a top perspective view of a riser of a garbage can riser system according to an embodiment of the disclosure.
Figure 2:
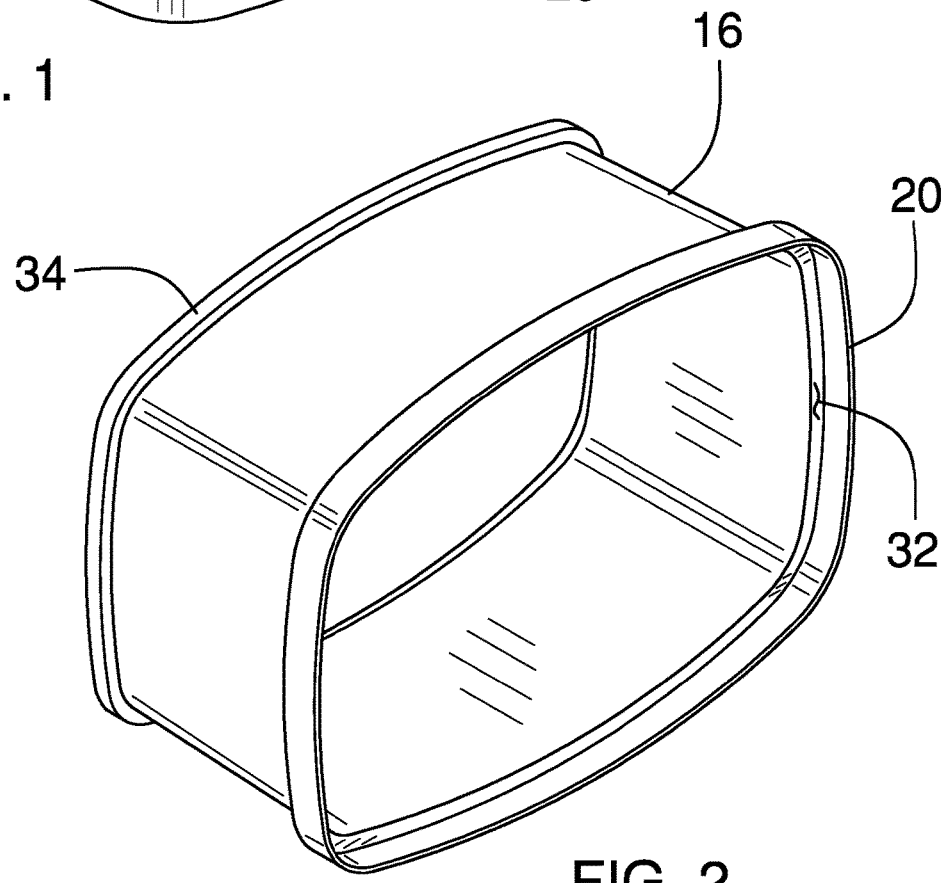
FIG. 2 is a bottom perspective view of a riser of an embodiment of the disclosure.
Figure 3:
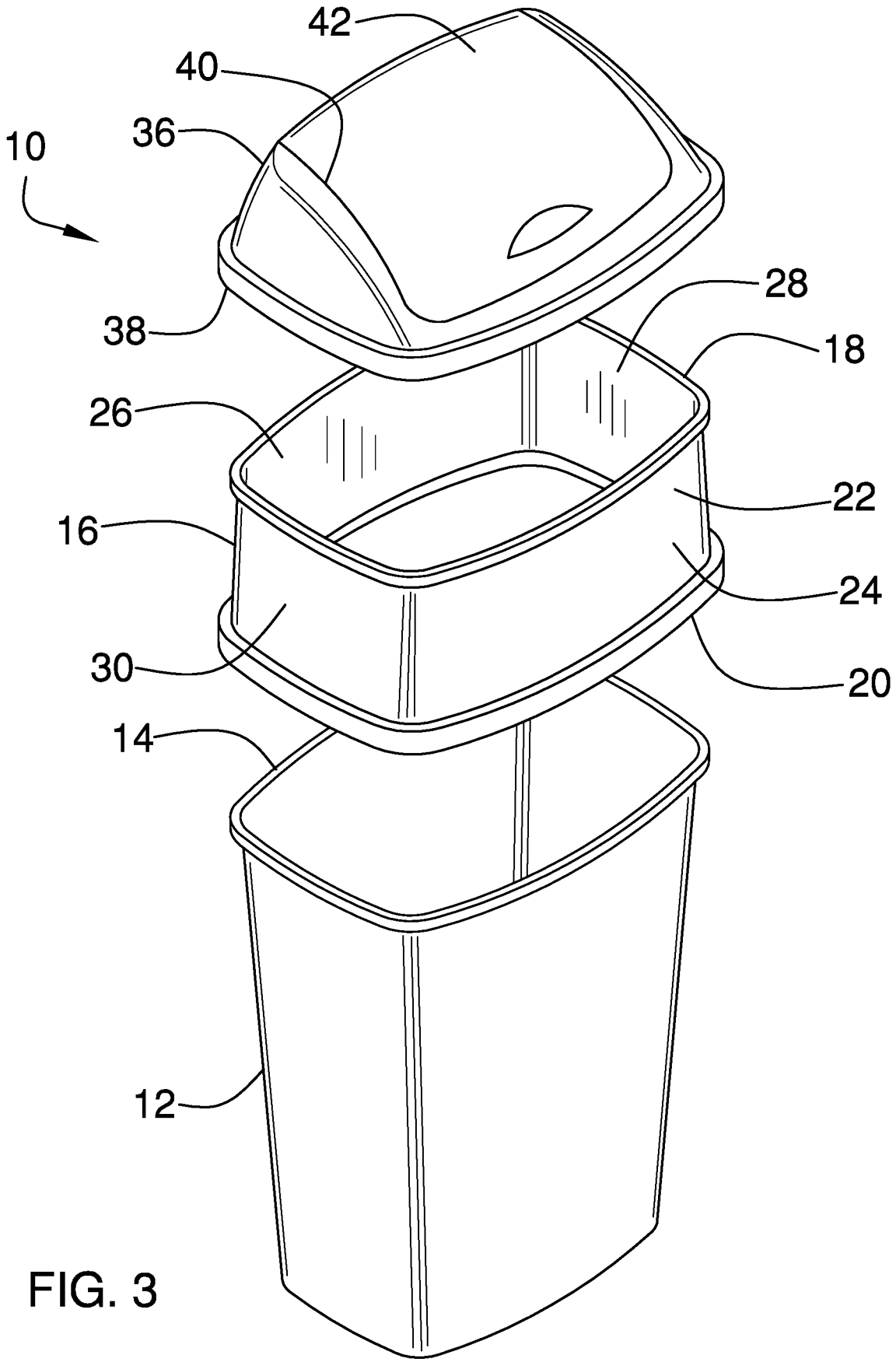
FIG. 3 is an exploded perspective view of an embodiment of the disclosure.
Figure 4:
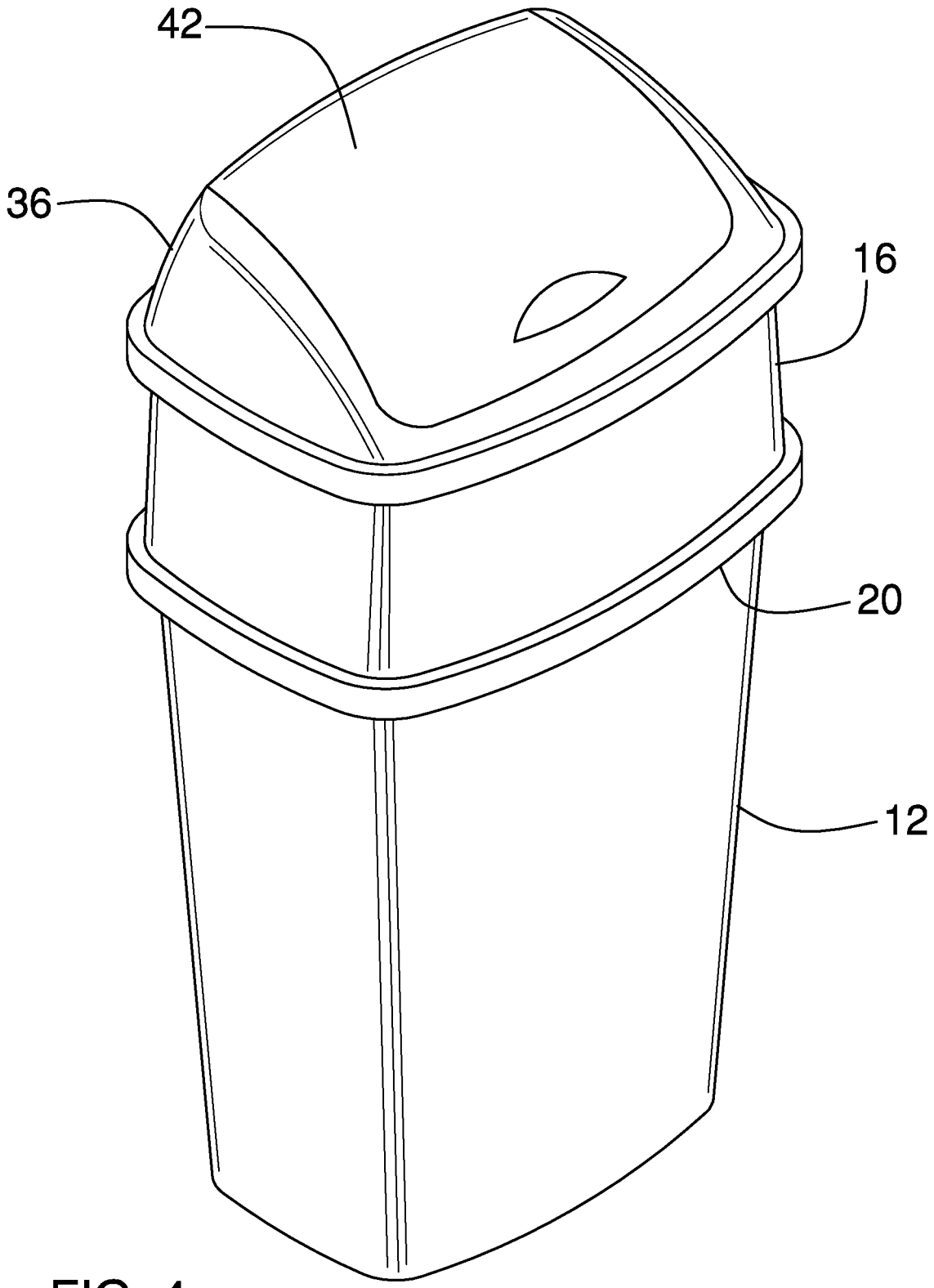
FIG. 4 is a front perspective view of an embodiment of the disclosure.
Figure 5:
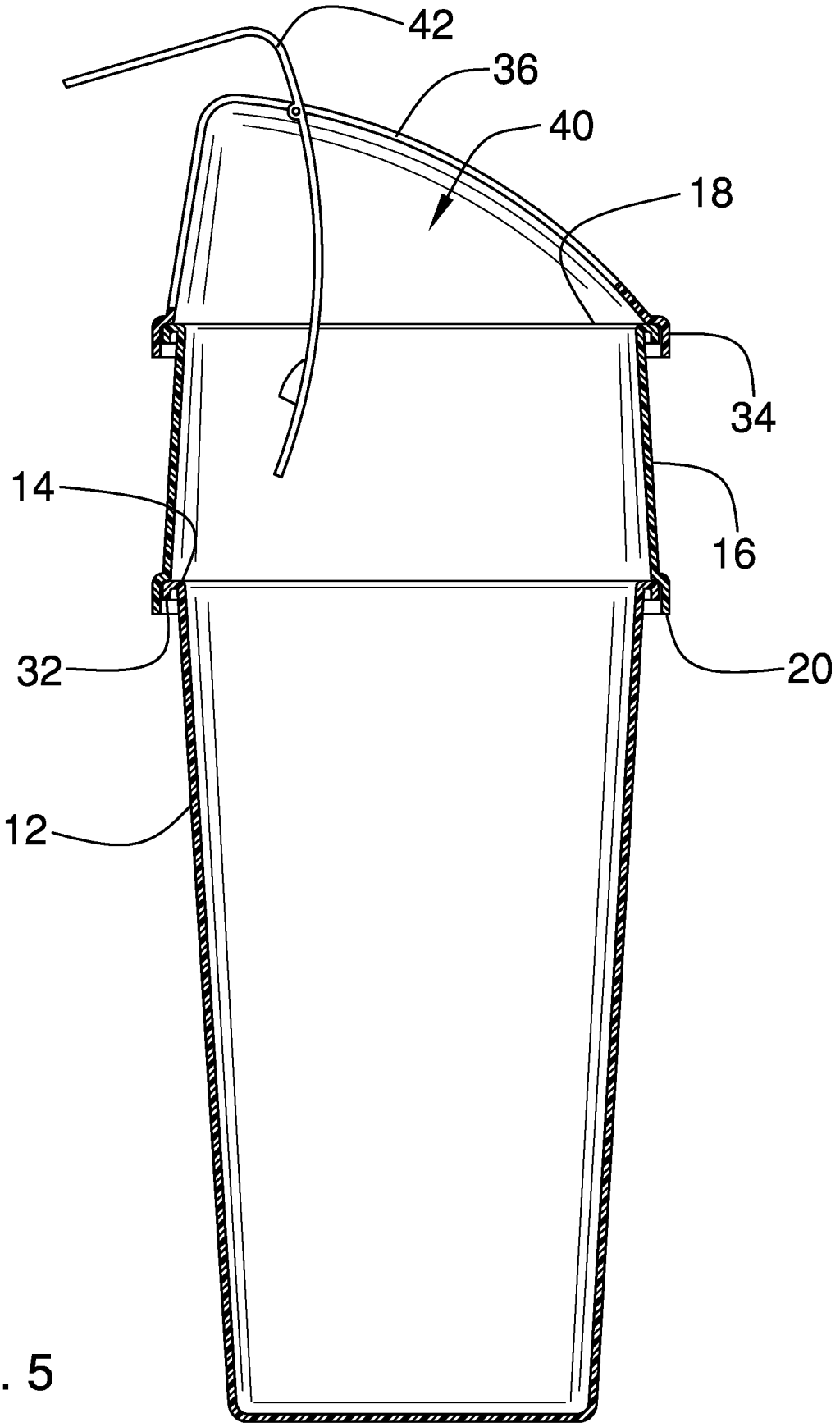
FIG. 5 is a left side cut-away view of an embodiment of the disclosure.
Figure 6:
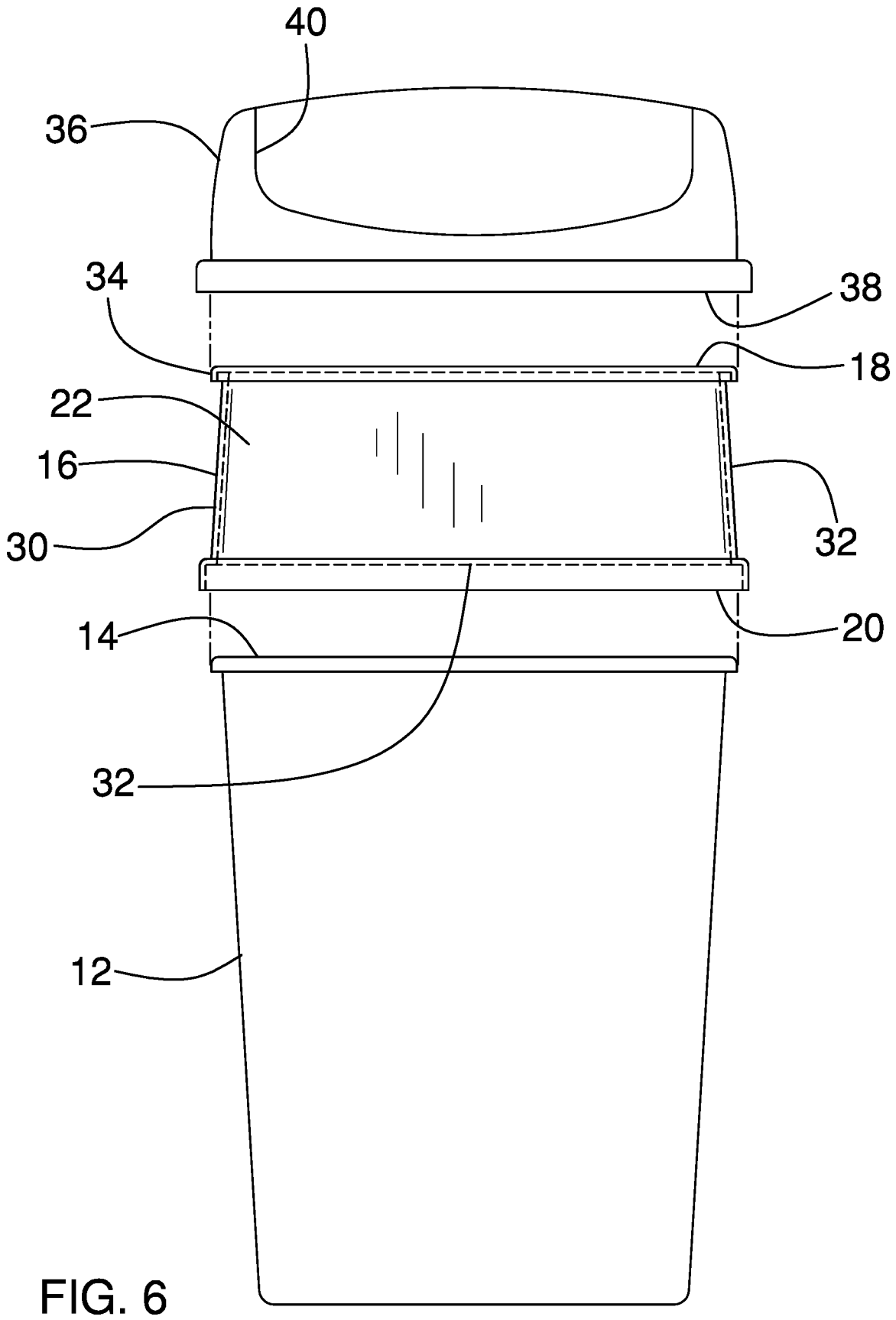
FIG. 6 is a front exploded perspective view of an embodiment of the disclosure.

With reference now to the drawings, and in particular to FIGS. 1 through 6 thereof, a new riser device embodying the principles and concepts of an embodiment of the disclosure and generally designated by the reference numeral 10 will be described.

As best illustrated in FIGS. 1 through 6, the garbage can riser system 10 generally comprises a garbage can 12 that has a top end 14 and the top end 14 is open. The garbage can 12 may be a kitchen garbage can, a bathroom garbage can or any other type of garbage can that might be found in a home or an office. A riser 16 is provided and the riser 16 is positionable on the top end 14 of the garbage can 12. In this way the riser 16 increases a functional height of the garbage can 12.

The riser 16 has an upper end 18, a lower end 20 and an outer wall 22 extending therebetween, and the outer wall 22 has a front side 24, a back side 26, a first lateral side 28 and a second lateral side 30. Each of the front side 24 and the back side 26 may have a length that is greater than a length of the first lateral side 28 and the second lateral side 30 such that the riser 16 has a rectangular shape. Each of the upper end 18 and the lower end 20 is open. Additionally, each of the upper end 18 and the lower end 20 may have dimensions that correspond to the dimensions of the top end 14 of the garbage can 12.

The outer wall 22 flares outwardly along the lower end 20 to define a horizontal surface 32 extending around an entire perimeter of the outer wall 22. The horizontal surface 32 is spaced from the lower end 20 of the riser 16. Moreover, the horizontal surface 32 rests on the top end 14 of the garbage can 12 having the outer wall 22 extending downwardly along the garbage can 12. In this way the riser 16 is inhibited from sliding off of the garbage can 12. The outer wall 22 has a lip 34 extending outwardly therefrom. The lip 34 extends around the entire perimeter of the outer wall 22 and the lip 34 is aligned with the upper end 18 of the riser 16.

A flip lid 36 is provided and the flip lid 36 is positionable on the riser 16. In this way the flip lid 36 is spaced above garbage contained in the garbage can 12. Thus, the entire volume of the garbage can 12 be filled with garbage without having the flip lid 36 contacting the garbage when the flip lid 36 is opened. The flip lid 36 may be a garbage can flip lid of any conventional design.

The flip lid 36 has a lower edge 38 and an opening 40 extending therethrough. The lower edge 38 engages the lip 34 on the outer all of the riser 16 having the flip lid 36 resting on the upper end 18 of the riser 16. Thus, the opening 40 in the flip lid 36 facilitates garbage to be placed into the garbage can 12. The flip lid 36 includes a panel 42 that is pivotally positioned in the opening 40 for opening and closing the opening 40. The riser 16 spaces the panel 42 at a sufficient height from the garbage can 12 to facilitating the panel 42 to pivot in the opening 40 without striking the garbage in the garbage can 12.

In use, the riser 16 is positioned on the garbage can 12 when a new garbage bag is positioned in the garbage can 12 and the flip lid 36 is positioned on the riser 16. In this way the flip lid 36 is spaced upwardly from the top end 14 of the garbage can 12. Moreover, the flip lid 36 can be opened even when the garbage can 12 is completely filled with garbage. In this way the entire volume of the garbage can 12 may be filled with garbage before the garbage bag is replaced.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A garbage can riser system being configured to elevate a flip lid of a garbage can above garbage contained in the garbage can, said system comprising:

a garbage can having a top end, said top end being open;

a riser being positionable on said top end of said garbage can for increasing a functional height of said garbage can;

a flip lid being positionable on said riser wherein said flip lid is configured to be spaced above garbage contained in said garbage can thereby facilitating the entire volume of said garbage can to be filled with garbage without having said flip lid contacting the garbage when said flip lid is opened, said flip lid including a panel being pivotally positioned in said opening for opening and closing said opening, said panel having a length extending away from a pivot point of said panel such that a distal edge of said panel relative to the pivot point is positioned below a lower edge of the flip lid when the flip lid is opened, said riser spacing said panel at a sufficient height from said garbage can to facilitating said panel to pivot in said opening without striking the garbage in said garbage can; and wherein said riser has an upper end, a lower end and an outer wall extending therebetween, said outer wall having a front side, a back side, a first lateral side and a second lateral side, each of said front side and said back side having a length being greater than a length of said first lateral side and said second lateral side such that said riser has a rectangular shape, each of said upper end and said lower end being open.

2. The system according to claim 1, wherein said outer wall flares outwardly along said lower end to define a horizontal surface extending around an entire perimeter of said outer wall, said horizontal surface being spaced from said lower end of said riser, said horizontal surface resting on said top end of said garbage can having said outer wall extending downwardly along said garbage can thereby inhibiting said riser from sliding off of said garbage can.

3. The system according to claim 1, wherein said outer wall has a lip extending outwardly therefrom, said lip extending around the entire perimeter of said outer wall, said lip being aligned with said upper end of said riser.

4. The system according to claim 3, wherein said flip lid has a lower edge, and an opening extending therethrough, said lower edge engaging said lip on said outer wall of said riser such that said opening facilitates garbage to be placed into said garbage can.

5. A garbage can riser system being configured to elevate a flip lid of a garbage can above garbage contained in the garbage can, said system comprising:

a garbage can having a top end, said top end being open;

a riser being positionable on said top end of said garbage can for increasing a functional height of said garbage can, said riser having an upper end, a lower end and an outer wall extending therebetween, said outer wall having a front side, a back side, a first lateral side and a second lateral side, each of said front side and said back side having a length being greater than a length of said first lateral side and said second lateral side such that said riser has a rectangular shape, each of said upper end and said lower end being open, said outer wall flaring outwardly along said lower end to define a horizontal surface extending around an entire perimeter of said outer wall, said horizontal surface being spaced from said lower end of said riser, said horizontal surface resting on said top end of said garbage can having said outer wall extending downwardly along said garbage can thereby inhibiting said riser from sliding off of said garbage can, said outer wall having a lip extending outwardly therefrom, said lip extending around the entire perimeter of said outer wall, said lip being aligned with said upper end of said riser; and a flip lid being positionable on said riser wherein said flip lid is configured to be spaced above garbage contained in said garbage can thereby facilitating the entire volume of said garbage can to be filled with garbage without having said flip lid contacting the garbage when said flip lid is opened, said flip lid having a lower edge, and an opening extending therethrough, said lower edge engaging said lip on said outer wall of said riser such that said opening facilitates garbage to be placed into said garbage can, said flip lid including a panel being pivotally positioned in said opening for opening and closing said opening, said panel having a length extending away from a pivot point of said panel such that a distal edge of said panel relative to the pivot point is positioned below the lower edge of the flip lid when the flip lid is opened, said riser spacing said panel at a sufficient height from said garbage can to facilitating said panel to pivot in said opening without striking the garbage in said garbage can.

* * * * *